US008567198B2

(12) United States Patent
Magni et al.

(10) Patent No.: US 8,567,198 B2
(45) Date of Patent: Oct. 29, 2013

(54) INJECTION NOZZLE HAVING CONSTANT DIAMETER PIN AND METHOD FOR OPERATING THE INJECTION NOZZLE

(75) Inventors: Fulvio Magni, Nussbaumen (CH); Dariusz Nowak, Untersiggenthal (CH); Tomasz Dobski, Poznan (PL); Rafal Slefarski, Kozieglowy (PL)

(73) Assignee: ALSTOM Technology Ltd., Baden (CH)

( * ) Notice: Subject to any disclaimer, the term of this patent is extended or adjusted under 35 U.S.C. 154(b) by 930 days.

(21) Appl. No.: 12/704,936

(22) Filed: Feb. 12, 2010

(65) Prior Publication Data

US 2011/0185741 A1 Aug. 4, 2011

(30) Foreign Application Priority Data

Jan. 29, 2010 (CH) ..... 0105/10

(51) Int. Cl.
*B05B 1/265* (2006.01)
*B05B 1/34* (2006.01)

(52) U.S. Cl.
USPC ..... 60/740; 239/518; 239/589; 239/5

(58) Field of Classification Search
USPC ..... 60/740, 742, 743; 239/5, 518, 589, 590, 239/590.5, 601; 431/350, 351, 352, 159, 12
See application file for complete search history.

(56) References Cited

U.S. PATENT DOCUMENTS

| | | | | |
|---|---|---|---|---|
| 1,944,371 | A * | 1/1934 | Ritz | 239/90 |
| 2,746,800 | A * | 5/1956 | Voit | 239/584 |
| 3,537,650 | A | 11/1970 | Peczeli et al. | |
| 3,693,889 | A * | 9/1972 | Schuster | 239/533.6 |
| 3,817,722 | A * | 6/1974 | Scott | 44/320 |
| 2007/0262171 | A1 * | 11/2007 | Wong | 239/296 |

FOREIGN PATENT DOCUMENTS

| | | |
|---|---|---|
| DE | 2654587 | 6/1978 |
| EP | 1793165 | 6/2007 |
| EP | 2085695 | 8/2009 |
| WO | WO2009/095100 | 8/2009 |

OTHER PUBLICATIONS

Search Report for Swiss Patent App. No. 0105/2010 (Jun. 23, 2010).

(Continued)

*Primary Examiner* — William H Rodriguez
*Assistant Examiner* — Carlos A Rivera
(74) *Attorney, Agent, or Firm* — Cermak Nakajima LLP; Adam J. Cermak

(57) ABSTRACT

An injection nozzle (10), especially for injecting liquid fuel, preferably crude oil, into the combustion chamber of a gas turbine, includes an inner chamber (16) which extends along a nozzle axis (19), conically tapers to a concentric nozzle orifice (17), and to which the medium which is to be injected is fed from outside through a plurality of inlet ports (18) which are arranged in a distributed manner around the nozzle axis (19). The inlet ports (18) are oriented perpendicularly to the nozzle axis (19) and each lead tangentially into the inner chamber (16). With such an injection nozzle, an improved spray cone is achieved by the fact that a pin (14), which extends in the axial direction, is concentrically arranged in the inner chamber (16) and passes through the region of the mouths of the inlet ports (18) and extends right into the nozzle orifice (17).

12 Claims, 4 Drawing Sheets

(56) References Cited

OTHER PUBLICATIONS

Kulshreshtha, D. B., et al., "Variations of Spray Cone Angle and Penetration Length of Pressure Swirl Atomizer Designed for Micro Gas Turbine Engine," International Journal of Dynamics of Fluids 2009; vol. 5, No. 2; pp. 165-172, Research India Publications.

Office Action from Egyptian Patent App. No. 2011010134 (Jan. 23, 2013).

* cited by examiner

INJECTION NOZZLE HAVING CONSTANT DIAMETER PIN AND METHOD FOR OPERATING THE INJECTION NOZZLE

This application claims priority under 35 U.S.C. §119 to Swiss application no. 00105/10, filed 29 Jan. 2010, the entirety of which is incorporated by reference herein.

BACKGROUND

1. Field of Endeavor

The present invention relates to the field of combustion technology, especially in connection with gas turbines. It relates to an injection nozzle and to a method for operating such an injection nozzle.

2. Brief Description of the Related Art

For the atomizing injection of liquid fuel into the combustion chamber of a gas turbine, a multiplicity of various injection nozzles, which differ with respect to their internal construction and the type of spray cone which is generated, are known from the prior art.

A fuel nozzle with swirl passage, which includes a sleeve and a pin, is known, for example, from WO 2009/095100. The pin is arranged in the sleeve so that the inner surface of the sleeve is connected in a positive manner to the outer generated surface of the pin. Along the outer generated surface of the pin extends a swirl passage in the form of a recess which winds in a helical manner around the center axis of the pin on the outer generated surface. As a result of the arrangement of the pin in the sleeve, a swirl passage is covered or delimited radially with regard to the center axis of the pin by the inner surface of the sleeve. The sleeve has a discharge orifice in the flow direction of the fuel which leaves the fuel nozzle. The pin is arranged in the sleeve so that the cover surface of the pin is recessed towards the discharge orifice of the sleeve. As a result, a swirl chamber is formed. In the swirl chamber, a mixing of the fuel—that is to say, of the oil in the present exemplary embodiment—with air takes place. As a result of the recessing, a film atomization instead of a jet atomization is furthermore enabled. It is also possible for the cover surface to align with the discharge orifice. In the case of the swirl chamber, the spray cone can only be adjusted with difficulty. If the cover surface aligns with the discharge orifice, the fuel only discharges at the ends of the swirl passages, that is to say is localized to a high degree. Furthermore, the production of the swirl passages is comparatively costly.

A liquid fuel nozzle for the combustion chamber of a gas turbine, which includes a nozzle cap 100, a nozzle insert 101, a pilot insert 102, and a nozzle body 103, is known from EP 1 793 165 (FIG. 1 there). The pilot insert 102 is arranged inside the nozzle insert 101. The nozzle insert 101 is, in turn, arranged inside the nozzle cap 100. The nozzle has a pilot passage 105 which supplies the pilot insert 102 with fuel. The pilot insert 102 has a swirl chamber 110 into which a pilot swirl orifice 107 tangentially leads. Pilot fuel 32 flows via the pilot passage 105 from the vicinity of the pilot insert 102 through the pilot swirl orifice 107 and maintains a swirl there, by which it moves in the swirl chamber 110. The pilot fuel 32 forms a film on the inner wall of the swirl chamber 110 and shoots from the pilot injection orifice 108 in fine droplets.

The construction and function of the pilot arrangement of EP 1 793 165 are comparable with a simplex swirl atomizer which has been described in an article by D. B. Kulshreshtha et al., Variations of Spray Cone Angle and Penetration Length of Pressure Swirl Atomizer Designed for Micro Gas Turbine Engine, Int. J. Dynamics of Fluids, Vol. 5, Number 2, pp. 165-172 (2009). In both cases, the fuel which is pressurized and provided with a swirl discharges from a circular hole. The swirl chamber, into which the fuel flows tangentially and perpendicularly to the nozzle axis, is formed as a simple chamber without devices which promote swirl. Both lead to a non-optimized design of the spray cone which, moreover, has a limited cone angle.

SUMMARY

One of numerous aspects of the present invention includes an injection nozzle for liquid fuels, especially in the form of crude oil, and methods for its operation.

Another aspect of the present invention includes that a pin, which extends in the axial direction, is concentrically arranged in the inner chamber of the injection nozzle, which pin passes through the region of the mouths of the inlet ports and extends right into the nozzle orifice. In the center of the inner chamber, the pin promotes swirl of the fuel which is introduced tangentially through the inlet ports. At the same time, the pin narrows the nozzle orifice to an annular gap, by which the forming of the spray cone is greatly improved.

One development includes that the nozzle orifice is formed with a circular shape, and that the pin has a circular cross section in the region of the nozzle orifice in such a way that an annular gap is formed between the pin and the boundary of the nozzle orifice.

The pin can especially be formed with a continuously cylindrical shape with a constant outside diameter.

It is also conceivable, however, for the pin to be formed with a cylindrical shape with a constant outside diameter and in the region of the nozzle orifice to have a shape which deviates from the cylindrical shape, especially being formed in a conically tapering manner.

Another development of the invention includes that the inner chamber, on the side opposite the nozzle orifice, is sealed off by a wall which is oriented perpendicularly to the nozzle axis, and that the pin extends up to the wall and is fastened on the wall. The pin can especially be formed in one piece together with the wall.

A further development includes that the inner chamber has a cylindrical section and a conically tapering section which adjoins the cylindrical section in an axial direction and leads into the nozzle orifice, and that the inlet ports lead into the cylindrical section of the inner chamber.

Another development of the invention includes that the inner chamber is concentrically encompassed by an outer chamber, and that the outer chamber is in communication with the inner chamber by the inlet ports.

The outer chamber in this case is preferably enclosed by a tubular housing which is open at one end and closed off at the other end by a nozzle plate, and the inner chamber is arranged in the nozzle plate.

The housing can especially include a cylindrical section and a conical section, and the nozzle plate with the inner chamber can be arranged in the cylindrical section of the housing.

Another development includes that at least three inlet ports are arranged in a uniformly distributed manner in one plane around the nozzle axis.

Good results are achieved if the nozzle orifice has an inside diameter of 3 mm and the pin has an outside diameter of 2 mm, and if three inlet ports are provided with an inside diameter of 1 mm in each case.

Good results are also achieved if the nozzle orifice has an inside diameter of 2.5 mm and the pin has an outside diameter of 2 mm, and if three inlet ports are provided with an inside diameter of 1 mm in each case.

The same also applies if the nozzle orifice has an inside diameter of 2.5 mm and the pin has an outside diameter of 1.8 mm, and if three inlet ports are provided with an inside diameter of 1 mm in each case.

In the case of a method according to principles of the present invention, the injection nozzle is pressurized with an injection pressure in the range of between 1 and 5 bar, or operated with a mass throughflow rate of between 40 and 120 kg/h.

BRIEF DESCRIPTION OF THE DRAWINGS

The invention shall subsequently be explained in more detail based on exemplary embodiments in conjunction with the drawing. In the drawing

DETAILED DESCRIPTION OF EXEMPLARY EMBODIMENTS

Figure 1:
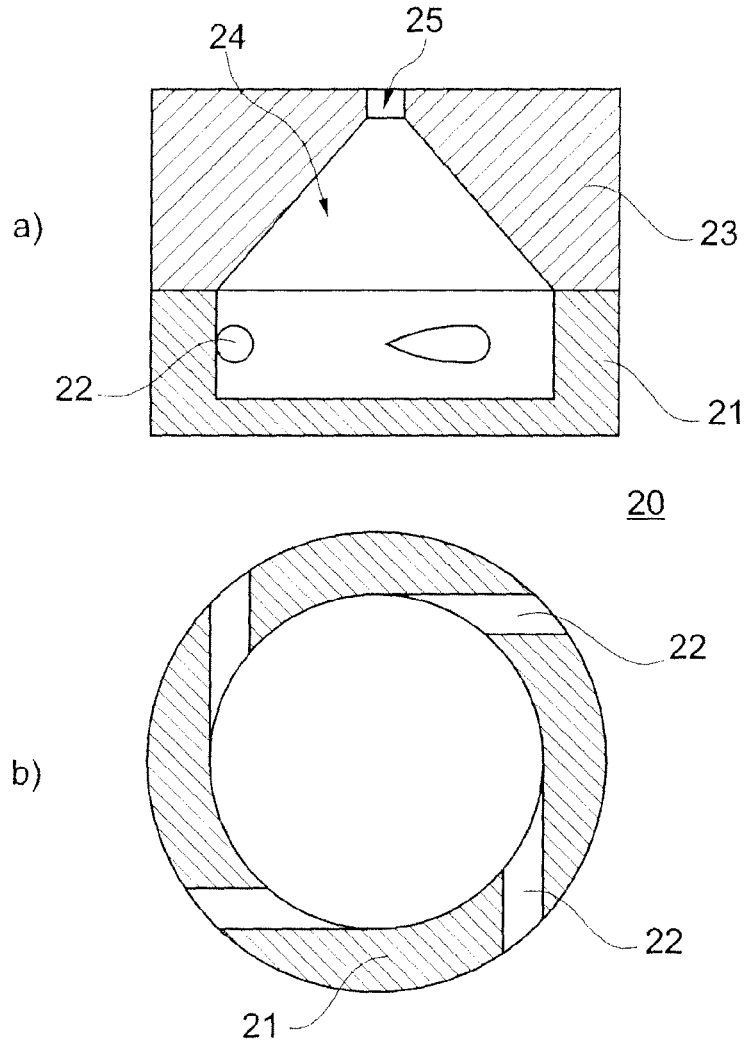
FIG. 1 shows, in longitudinal section (FIG. 1*a*) and in lateral cross-section (FIG. 1*b*), the construction of an injection nozzle with inner chamber and four tangential inlet ports, as is the starting point of the present invention.

In FIG. 1, in longitudinal section (FIG. 1*a*) and in lateral cross section (FIG. 1*b*), the construction of an injection nozzle with inner chamber is reproduced, as is the starting point of nozzles embodying principles of the present invention. The injection nozzle 20 is assembled from a rear section 21 and a front section 23 which abut against each other and therefore define an inner chamber 24. The inner chamber 24 includes a cylindrical section, which is arranged in the rear section 21, and a conically tapering section which is accommodated in the front section 23. The pointed end of the conical section merges into a circular nozzle orifice 25 through which pressurized liquid fuel in the form of a spray cone can discharge outwards.

The fuel is introduced into the inner chamber 24 from outside through four inlet ports 22 which lie in one plane and lead tangentially into the inner chamber 24. The tangential orientation of the inlet ports 22 ensures that the fuel which flows into the inner chamber 24 maintains a swirl around the nozzle axis (19 in FIG. 3), which contributes to the forming of extremely fine droplets in the spray cone.

Starting from the configuration of FIG. 1, a pin is arranged in the inner chamber, which on the one hand promotes the swirl of the fuel which flows into the inner chamber, and on the other hand narrows the nozzle orifice to an annular gap.

Figure 2:
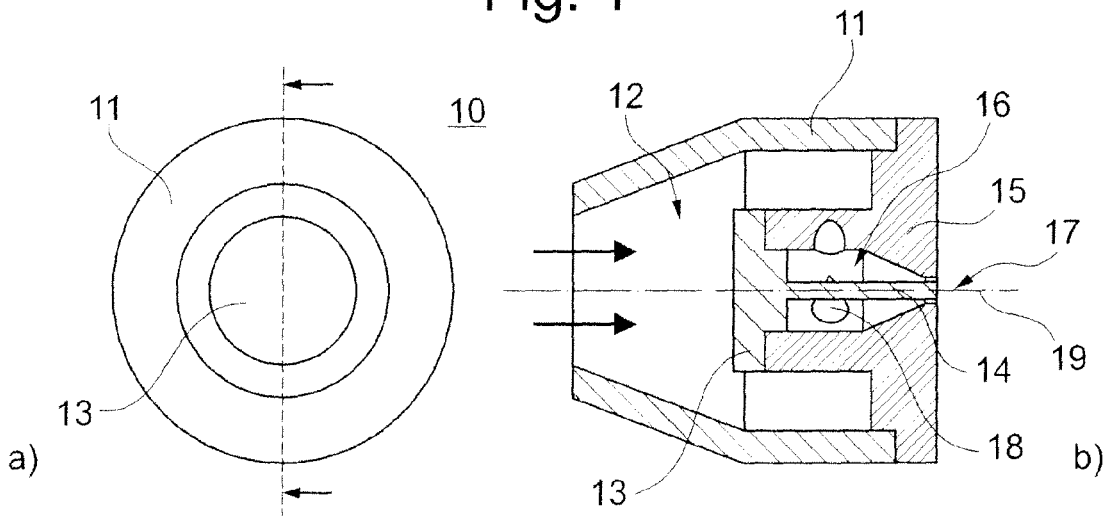
FIG. 2 shows, in a rear elevational view (FIG. 2*a*) and in longitudinal section (FIG. 2*b*), an injection nozzle according to an exemplary embodiment of the invention.
Figure 3:
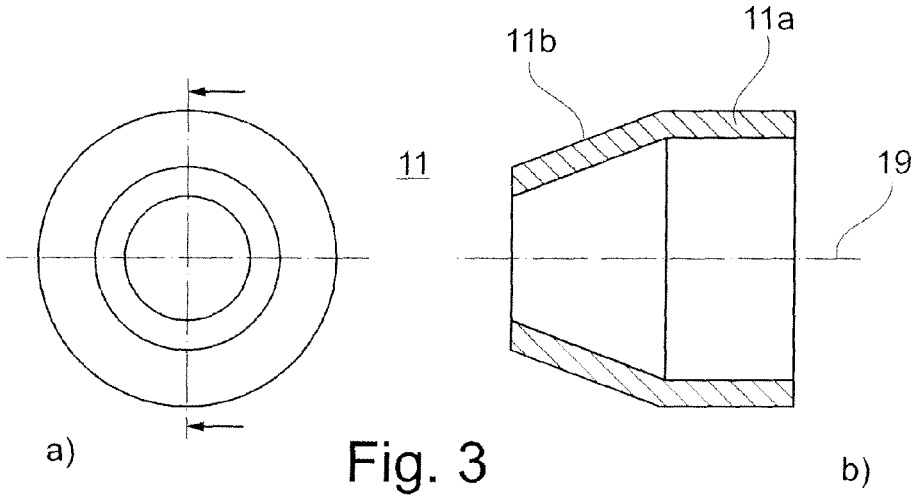
FIG. 3 shows, in a rear elevational view (FIG. 3*a*) and in longitudinal section (FIG. 3*b*), the housing of the injection nozzle according to FIG. 2.
Figure 4:
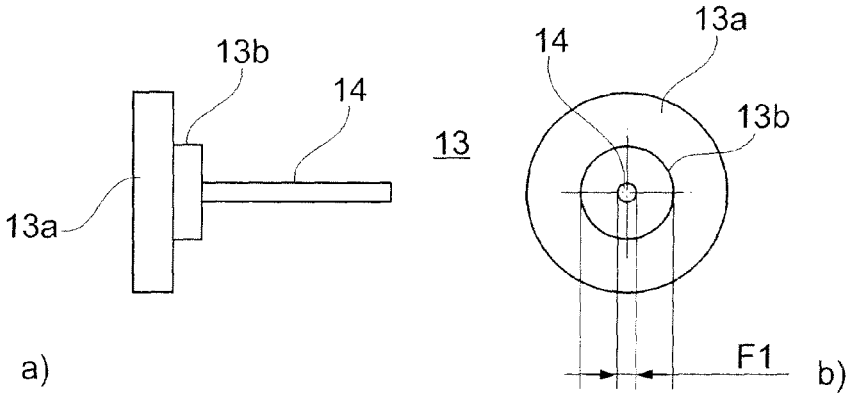
FIG. 4 shows, in a side elevational view (FIG. 4*a*) and in a front elevational view (FIG. 4*b*), the insert with pin of the injection nozzle according to FIG. 2.
Figure 5:
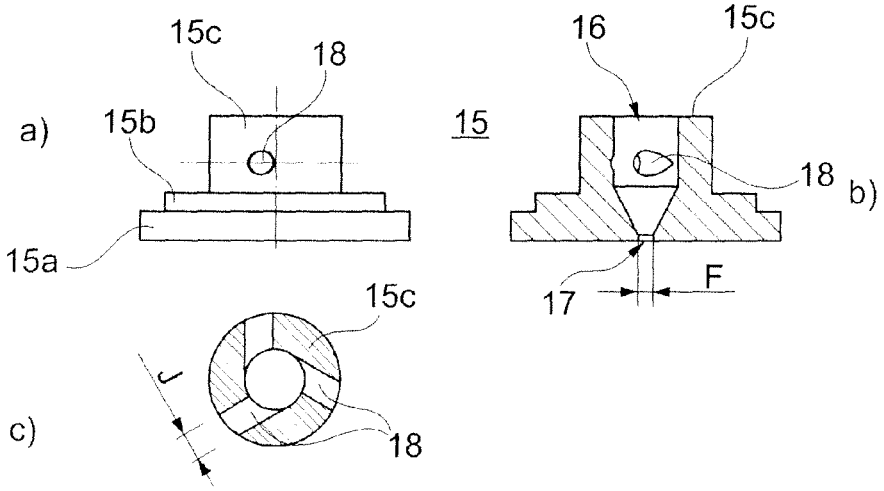
FIG. 5 shows, in a side elevational view (FIG. 5*a*), in longitudinal cross-section (FIG. 5*b*), and in lateral cross-section (FIG. 5*c*), the nozzle plate (FIG. 5*c*) with the inner chamber and the nozzle orifice of the injection nozzle according to FIG. 2.

FIG. 2 shows, in a rear elevational view (FIG. 2*a*) and in longitudinal cross-section (FIG. 2*b*), a corresponding injection nozzle according to an exemplary embodiment of the invention. The individual parts, from which the injection nozzle 10 of FIG. 2 is assembled, are shown in FIGS. 3, 4, and 5 in different views.

The injection nozzle 10 has an outer chamber 12 and an inner chamber 16. The outer chamber 12 is delimited on the outside by a tubular housing 11, which, according to FIG. 3, lies concentrically to the nozzle axis 19 and includes a cylindrical section 11*a* and a (frusto-)conical section 11*b*. On the side of the conical section 11*b*, the housing 11 is open so that from there fuel can flow unhindered into the outer chamber 12. On the opposite side, the housing 11 is sealed off on the outside by a circular disk-shaped nozzle plate 15 which is equipped with a disk 15*a* and a shoulder 15*b*.

Inside a cylindrical section 15*c* (FIG. 5), which is formed on the nozzle plate 15 and projects rearwards into the outer chamber 12, provision is made for a concentric inner chamber 16. The inner chamber 16, by a conically tapering section which extends through the disk 15*a*, leads to a circular nozzle orifice 17 which is arranged on the front side of the nozzle plate 15 and has an inside diameter F (FIG. 5*b*). At the rear, a cylindrical section, which at the rear end is closed off by the disk 13*a* and a shoulder 13*b* of an insert 13, adjoins the conical section of the inner chamber 16. On the insert 13, an axially oriented pin 14 is formed, which extends centrally through the inner chamber 16 up to the nozzle orifice 17 and closes off the nozzle orifice 17 except for an annular gap. Through the annular gap which has been left open, fuel which is in the inner chamber 16 can discharge outwards, forming a spray cone.

The fuel can flow from the outer chamber 12 into the inner chamber 16 through a plurality of inlet ports 18 which are distributed uniformly around the nozzle axis 19 and arranged in a plane which is oriented perpendicularly to the nozzle axis (in the example of FIG. 2 there are three inlet ports altogether; see FIG. 5*c*). The inlet ports 18 lead tangentially into the inner chamber 16 (FIG. 5*c*) so that the inflowing fuel maintains a strong swirl around the pin 14, which, inter alia, as a result of the pin 14 continues almost unhindered up to the nozzle orifice 17. The inlet ports 18 have the inside diameter J in each case (FIG. 5*c*).

Figure 6:
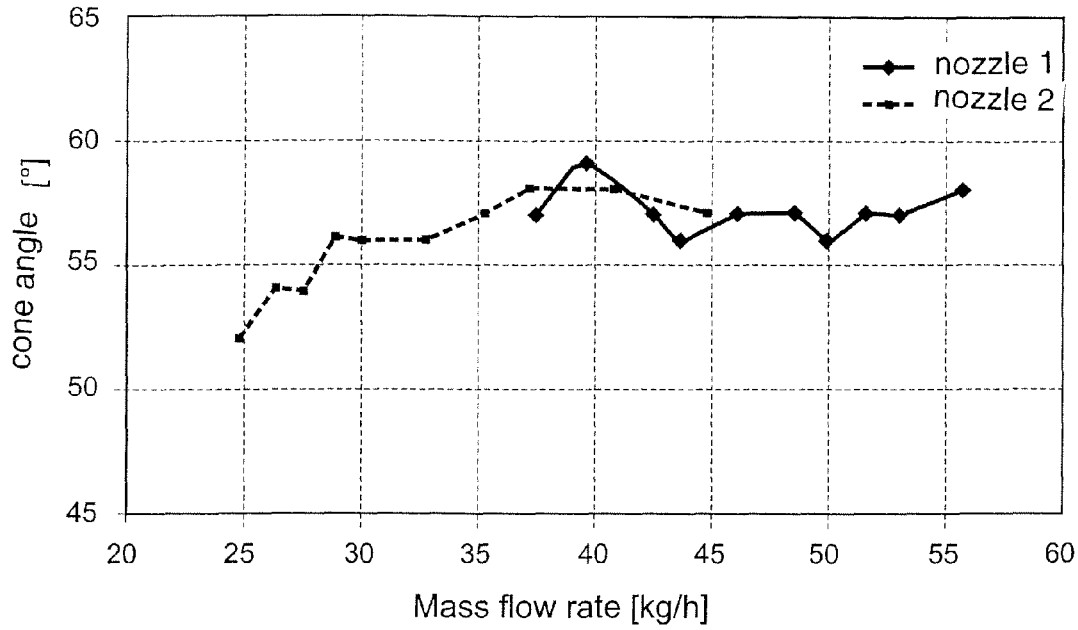
FIG. 6 shows a graph of the dependency of the cone angle of the spray cone of an injection nozzle according to FIG. 1 without a pin in dependence upon the mass throughflow, for two different sets of nozzle parameters.

With injection nozzles of the type which is shown in FIG. 1 and FIG. 2, measurements were carried out, wherein specific parameters of the injection nozzle were varied. The results are reproduced in the form of graphs in FIGS. 6, 7, 8, and 9. FIG. 6 shows a graph of the dependency of the cone angle of the spray cone of an injection nozzle according to FIG. 1 without a pin in dependence upon the mass throughflow for two different sets of nozzle parameters and for the medium of water at injection pressures of between 1 and 8 bar. The one injection nozzle (diamonds in FIG. 6) had an inside diameter of the nozzle orifice 25 of 0.9 mm, an inside diameter of the inlet ports 22 of 1.5 mm, a diameter in the cylindrical section of the inner chamber 24 of 12.2 mm, and an axial length of the inner chamber 24 of 12.1 mm. The other injection nozzle (squares in FIG. 6) had an inside diameter of the nozzle orifice 25 of 0.9 mm, an inside diameter of the inlet ports 22 of 1.0 mm, a diameter in the cylindrical section of the inner chamber 24 of 7 mm, and an axial length of the inner chamber 24 of 6 mm. It is apparent that the cone angle does not vary a great deal with the mass throughflow and remains below 60° even in the case of high mass throughflows of more than 55 kg/h.

Figure 7:
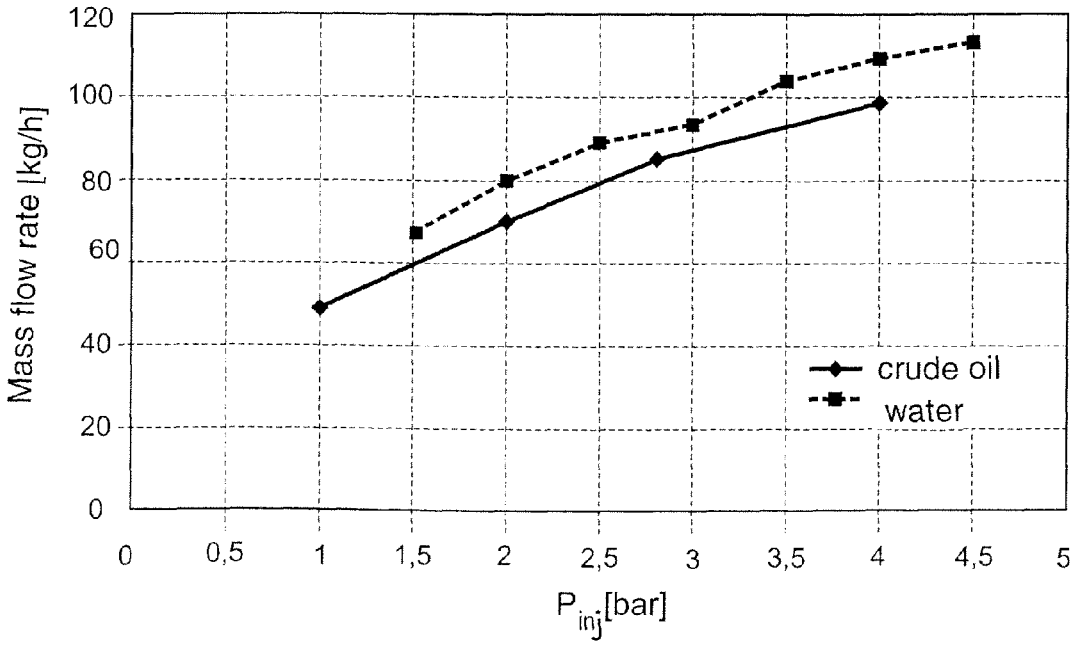
FIG. 7 shows a graph of the dependency of the mass throughflow of injection pressure ($p_{inj}$) for an exemplary injection nozzle according to FIG. 2, for water and crude oil.

FIG. 7 shows a graph of the dependency of the mass throughflow of injection pressure ($p_{inj}$) for an exemplary injection nozzle according to FIG. 2, for water and crude oil. The injection nozzle 10 in this case had three inlet ports 18 with an inside diameter of J=1 mm, the nozzle orifice 17 had an inside diameter of F=3 mm, and the pin 14 was continuously cylindrical with an outside diameter of F1=2 mm, so that an annular gap with a gap width of 0.5 mm resulted.

Figure 8:
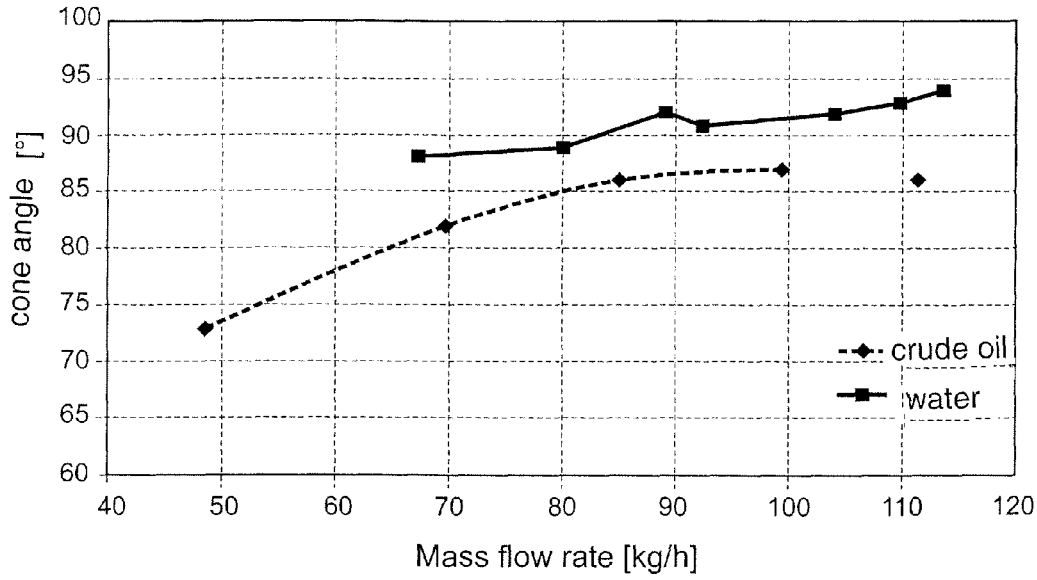
FIG. 8 shows a graph of the dependency of the cone angle of the spray cone of an injection nozzle according to FIG. 2 with a pin in dependence upon the mass throughflow, for water and crude oil.

In comparison to FIG. 6, FIG. 8 shows a graph of the dependency of the cone angle of the spray cone of an injection nozzle according to FIG. 2 with a cylindrical pin in dependence upon the mass throughflow for water and crude oil, wherein it concerns the same injection nozzle 10 as in FIG. 7.

Figure 9:
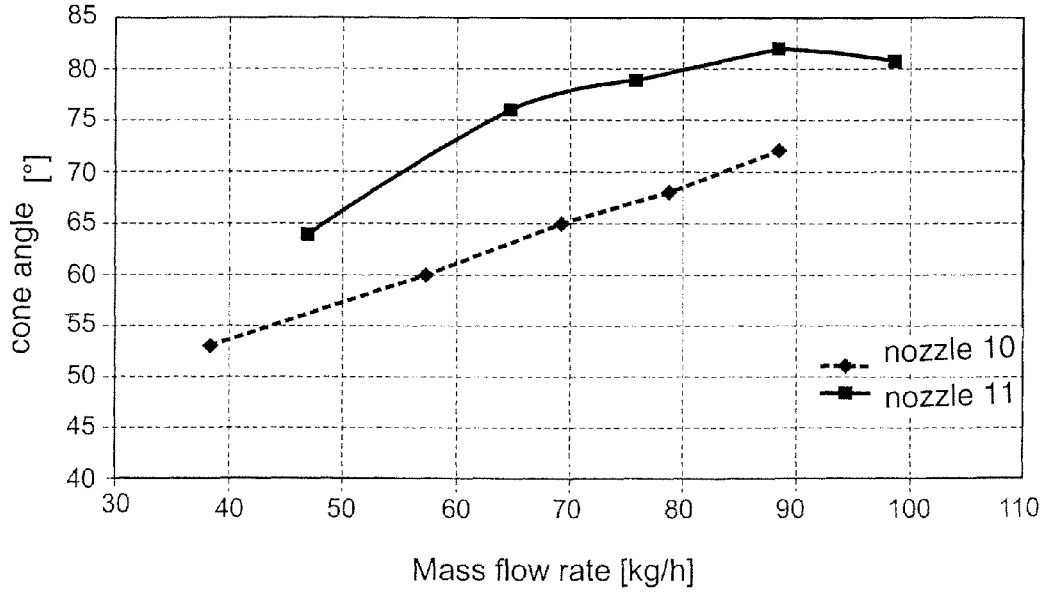
FIG. 9 shows a graph of the dependency of the cone angle of the spray cone of an injection nozzle according to FIG. 2 with a pin in dependence upon the mass throughflow, for two other sets of nozzle parameters.

FIG. 9 finally shows a graph of the dependency of the cone angle of the spray cone of an injection nozzle 10 according to FIG. 2 with a cylindrical pin 14 in dependence upon the mass throughflow for two other sets of nozzle parameters, wherein the one injection nozzle (squares in FIG. 9) has three inlet ports 18 with J=1 mm, a nozzle orifice 17 with F=2.5 mm, and an outside diameter of the pin 14 with F1=2 mm, while the other injection nozzle (diamonds in FIG. 9) has three inlet ports 18 with J=1 mm, a nozzle orifice 17 with F=2.5 mm, and an outside diameter of the pin 14 with F1=1.8 mm.

It is apparent that compared with an injection nozzle without a central pin, significantly larger cone angles result both for water and for crude oil. Without the pin, the nozzle orifice 25 (FIG. 1) is filled with the medium and the angle of the spray cone is largely constant. The rotational speed (in the swirl) is greatly reduced and the speed in the axial direction is increased. The pin 14 on the other hand forces a rotating flow (swirled flow) with a high rotational speed inside the nozzle orifice 17. The injection nozzle is therefore especially suitable for use in the combustion chamber of a gas turbine with a multiplicity of different injection points.

An injection nozzle according to principles of the present invention is especially suitable for crude oil (high density). It is comparatively small and characterized by a large swirl in the inner chamber. This leads to the surface stress, which without the pin 14 is so great that the spray cone is only about 50-55° ("plain jet"; see FIG. 6), losing its influence. As a result of the pin 14, the spray angle can therefore be appreciably enlarged (to about 90-100°; see FIGS. 8, 9). The shape of the pin 14, as already mentioned, does not necessarily have to be cylindrical; a tapering shape or the like could also be possible.

LIST OF DESIGNATIONS

10, 20 Injection nozzle
11 Housing
11*a* Cylindrical section
11*b* Conical section
12 Outside diameter
13 Insert
13*a* Disk
13*b* Shoulder
14 Pin
15 Nozzle plate
15*a* Disk
15*b* Shoulder
15*c* Cylindrical section
16, 24 Inner chamber
17, 25 Nozzle orifice
18, 22 Inlet port
19 Nozzle axis
21 Rear section
23 Front section
F Inside diameter (nozzle orifice)
F1 Outside diameter (pin)
J Inside diameter (inlet port)
$p_{inj}$ Injection pressure While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. An injection nozzle useful for injecting liquid fuel into the combustion chamber of a gas turbine, the injection nozzle comprising:

a plate comprising a nozzle orifice and an inner chamber which extends along a nozzle axis, the inner chamber conically tapering to the nozzle orifice, and a plurality of inlet ports distributed around the nozzle axis through which the fuel which is to be injected can be fed from outside the plate into the inner chamber and towards the combustion chamber of the gas turbine;

wherein the inlet ports are oriented perpendicularly to the nozzle axis and each extends tangentially into the inner chamber; and a solid pin extending along the nozzle axis in the inner chamber and passing through a region of the inner chamber including mouths of the inlet ports and extending into the nozzle orifice;

wherein the nozzle orifice is circular and the solid pin has a circular lateral cross-section in the region of the nozzle orifice and is sized to form an annular gap between the solid pin and a portion of the plate defining the nozzle orifice; and wherein the solid pin has a continuously cylindrical shape with a constant outside diameter through its entire length.

2. The injection nozzle as claimed in claim 1, further comprising:

a wall opposite the nozzle orifice which seals off the inner chamber, the wall being oriented perpendicular to the nozzle axis; and wherein the solid pin extends to and is fastened on the wall.

3. The injection nozzle as claimed in claim 1, wherein:

the inner chamber has a cylindrical section and a conically tapering section which axially adjoins the cylindrical section and leads into the nozzle orifice; and the inlet ports lead into the cylindrical section of the inner chamber.

4. The injection nozzle as claimed in claim 1, further comprising:

an outer chamber concentrically surrounding the inner chamber, wherein the outer chamber is in communication with the inner chamber through the inlet ports.

5. The injection nozzle as claimed in claim 4, further comprising:

a tubular housing enclosing the outer chamber, the tubular housing being open at a first end and closed off at a second end by the plate.

6. The injection nozzle as claimed in claim 5, wherein:

the housing comprises a cylindrical section and a conical section; and the plate is in the housing cylindrical section.

7. The injection nozzle as claimed in claim 1, wherein the plurality of inlet ports comprises at least three inlet ports uniformly arranged in one plane around the nozzle axis.

8. The injection nozzle as claimed in claim 1, wherein:

the nozzle orifice has an inside diameter of 3 mm and the solid pin has an outside diameter of 2 mm; and the plurality of inlet ports comprises three inlet ports each with an inside diameter of 1 mm.

9. The injection nozzle as claimed in claim 1, wherein:

the nozzle orifice has an inside diameter of 2.5 mm and the solid pin has an outside diameter of 2 mm; and the plurality of inlet ports comprises three inlet ports each with an inside diameter of 1 mm.

10. The injection nozzle as claimed in claim 1, wherein:

the nozzle orifice has an inside diameter of 2.5 mm and the solid pin has an outside diameter of 1.8 mm; and the plurality of inlet ports comprises three inlet ports each with an inside diameter of 1 mm.

11. A method for operating an injection nozzle, the method comprising:

providing an injection nozzle having a plate comprising a nozzle orifice and an inner chamber which extends along a nozzle axis, the inner chamber conically tapering to the nozzle orifice, and a plurality of inlet ports distributed around the nozzle axis through which the fuel which is to be injected can be fed from outside the plate into the chamber, wherein the inlet ports are oriented perpendicularly to the nozzle axis and each extends tangentially into the inner chamber, and a solid pin extending along the nozzle axis in the inner chamber and passing through a region of the inner chamber including mouths of the inlet ports and extending into the nozzle orifice, wherein the nozzle orifice is circular and the solid pin has a circular lateral cross-section with a continuously cylindrical shape having a constant outside diameter through its entire length in the region of the nozzle orifice and is sized to form an annular gap between the solid pin and a portion of the plate defining the nozzle orifice, the nozzle orifice has an inside diameter of 3 mm and the solid pin has an outside diameter of 2 mm, and the plurality of inlet ports comprises three inlet ports each with an inside diameter of 1 mm;

pressurizing liquid fuel in the injection nozzle at an injection pressure between 1 bar and 5 bar, or flowing liquid fuel with a mass throughflow rate of between 40 kg/hr and 120 kg/hr; and providing a gas turbine including a combustion chamber such that liquid fuel exits the nozzle orifice into the combustion chamber.

12. The method according to claim 11, wherein the liquid fuel comprises crude oil.

* * * * *